US006182289B1

(12) United States Patent
Brown

(10) Patent No.: US 6,182,289 B1
(45) Date of Patent: Feb. 6, 2001

(54) BASEBALL GLOVE HAVING ENHANCED FLEXIBILITY

(76) Inventor: Tony A. Brown, 13810 Sutton Park Dr. North, Apt 1111, Jacksonville, FL (US) 32224

( * ) Notice: Under 35 U.S.C. 154(b), the term of this patent shall be extended for 0 days.

(21) Appl. No.: 09/389,310

(22) Filed: Sep. 2, 1999

(51) Int. Cl.[7] ..... A41D 13/08
(52) U.S. Cl. ..... 2/19; 2/161.1; 473/458
(58) Field of Search ..... 2/19, 159, 161.1; 473/458

(56) References Cited

U.S. PATENT DOCUMENTS

| | | | | |
|---|---|---|---|---|
| 2,452,695 | | 11/1948 | Sonnett et al. | 2/19 |
| 3,169,250 | * | 2/1965 | Heiman | 2/19 |
| 3,590,389 | | 7/1971 | Latina | 2/19 |
| 4,527,287 | | 7/1985 | Aoki | 2/19 |
| 4,651,345 | | 3/1987 | Latina | 2/19 |
| 4,817,209 | | 4/1989 | Lehmann et al. | 2/19 |
| 4,853,975 | * | 8/1989 | Clevenhagen | 2/19 |
| 4,891,845 | | 1/1990 | Hayes | 2/19 |
| 4,896,376 | | 1/1990 | Miner | 2/19 |
| 5,253,365 | | 10/1993 | Clevenhagen | 2/19 |
| 5,379,460 | | 1/1995 | Aoki | 2/19 |
| 5,448,775 | | 9/1995 | Yamada et al. | 2/19 |
| 5,551,083 | * | 9/1996 | Goldsmith | 2/19 |
| 5,572,739 | | 11/1996 | Kolada et al. | 2/19 |
| 5,694,641 | | 12/1997 | Doi et al. | 2/19 |
| 5,799,327 | | 9/1998 | Clevenhagen | 2/19 |

* cited by examiner

*Primary Examiner*—John J. Calvert
*Assistant Examiner*—Katherine Moran
(74) *Attorney, Agent, or Firm*—Wood, Herron & Evans, L.L.P.

(57) ABSTRACT

A preferred version of the baseball glove 10 has a flexible hinge 38 which extends across the front panel 12, underneath the web 32, and part-way along the length of the back panel 14. The flexible hinge 38 includes first and second hinge edges 68, 70, 74, 76 connected to each other by a flexible spanning member 88. The glove 10 provides enhanced flexibility, which is particularly beneficial to ball players with developing hand-flex strength, and to ball players who do not want to insert the time, energy, and expense required to break in a conventional glove.

26 Claims, 3 Drawing Sheets

BASEBALL GLOVE HAVING ENHANCED FLEXIBILITY

BACKGROUND OF THE INVENTION

This invention relates to baseball gloves, and in particular, to baseball gloves having enhanced flexibility.

As baseball players of all ages readily will appreciate, a great deal of time and effort is required to "break in" a glove once it has been purchased. A new glove tends to be quite stiff and inflexible, thereby making it difficult to use. In order to compensate for this problem, baseball players try many different tricks. For example, some players attempt to break in a glove by soaking it in water and/or treating it with a glove softening agent such as glove oil. Still other players physically force the glove back and forth in an effort to reduce the stiffness, while others fold a glove and put weight on top of the folded glove, in an effort to reduce the stiffness. However, these various methods are time consuming, frustrating, and sometimes ineffective. Moreover, having spent money on a glove, a player may very well have to spend more money just to make the glove playable. While glove stiffness and inflexibility present a problem for any player, the problem is especially severe for those with a hand-flexing strength which is relatively low or which is just beginning to develop.

SUMMARY OF THE INVENTION

The present invention overcomes the above-mentioned drawbacks by providing a baseball glove having a hinge which includes a first hinge edge connected to a second hinge edge, thereby providing a glove with significantly enhanced flexibility, and which, for most users, is ready to use "out of the box". As used herein, the term "baseball" refers not only to baseball, but also to softball, tee-ball, and any other similarly styled ball-catching sport, as will be appreciated by those of ordinary skill in the art. Accordingly, the glove of the present invention may be used for any such sport. In addition to the hinge described above, the baseball glove includes: a glove shell having a front panel, a back panel, a thumb stall, a finger stall, and a hand-receiving opening; and a web positioned between the thumb stall and the finger stall.

In one aspect of the invention, the front panel includes a bottom edge, and the hinge extends along the front panel, between the web and the bottom edge, thereby significantly increasing the flexibility of the glove. In this aspect of the invention, if desired, the first hinge edge may be connected to the second hinge edge by a front flexible spanning member. In addition, the first and second hinge edges may taper toward the bottom edge. In further detail, the front panel of the baseball glove has a base region which is positioned between the finger stall and the bottom edge. If desired, the front panel hinge may extend between the web and this base region. Moreover, the front panel hinge may extend fully from the web to the bottom edge.

In another aspect of the invention, the web of the baseball glove has an upper region including a first section having a first overwrap piece. If desired, the upper region may further include a second section having a second overwrap piece. In such a version, the upper region may include a third section positioned between the first and second sections, with the third section being free of an overwrap piece.

In another aspect, the web has a front layer which includes an upper region and a lower region, with the front layer including a first pleat which extends between the upper region and the lower region. If desired, the web may further include a back layer, with the back layer having an upper region and a lower region, as well as a first pleat which extends between these upper and lower regions. These various pleats assist in providing a web with a pocket which may expand upon receiving a ball, thereby absorbing some of the force of the ball, as well as creating a slightly deeper, enlarged pocket, thereby making it easier for a ball player to catch and retain a ball within the pocket. In addition, if desired, the baseball glove may further include a ball-retention member adjacent the bottom edge of the front panel. This retention member assists a player by making it more difficult for a ball to roll across and off of the front panel of the glove.

In yet another aspect of the invention, a hinge is positioned along the back panel of the baseball glove. In further detail, the back panel of the glove shell includes a bottom edge, with the back panel hinge extending along the back panel between the web and this bottom edge. In further detail, the back panel hinge includes a first hinge edge connected to a second hinge edge. If desired, the first hinge edge may be connected to the second hinge edge by a back flexible spanning member.

In a further aspect of the invention, the baseball glove includes both a front panel hinge and a back panel hinge. If desired, the first and second hinge edges of each of the front and back panel hinges may be connected by a flexible spanning member. Moreover, the respective front and back flexible spanning members may be directly connected together. Alternatively, a single piece of flexible spanning member material may serve to form the front and back spanning members, with the material extending from the front panel to the back panel. This aspect of the invention, which includes both a front panel hinge and a back panel hinge, provides significantly enhanced flexibility, thereby making it even easier for a player to trap and retain a ball within the glove.

These and other objects and advantages of the present invention will be made apparent from the accompanying drawings and the detailed description of the drawings.

BRIEF DESCRIPTION OF THE DRAWINGS

The accompanying drawings, which are incorporated in, and constitute a part of, this specification, illustrate an embodiment of the invention, and, together with the general description given above, and the detailed description of the drawings given below, serve to explain the principles of the invention.

DETAILED DESCRIPTION OF THE DRAWINGS

Figure 1:
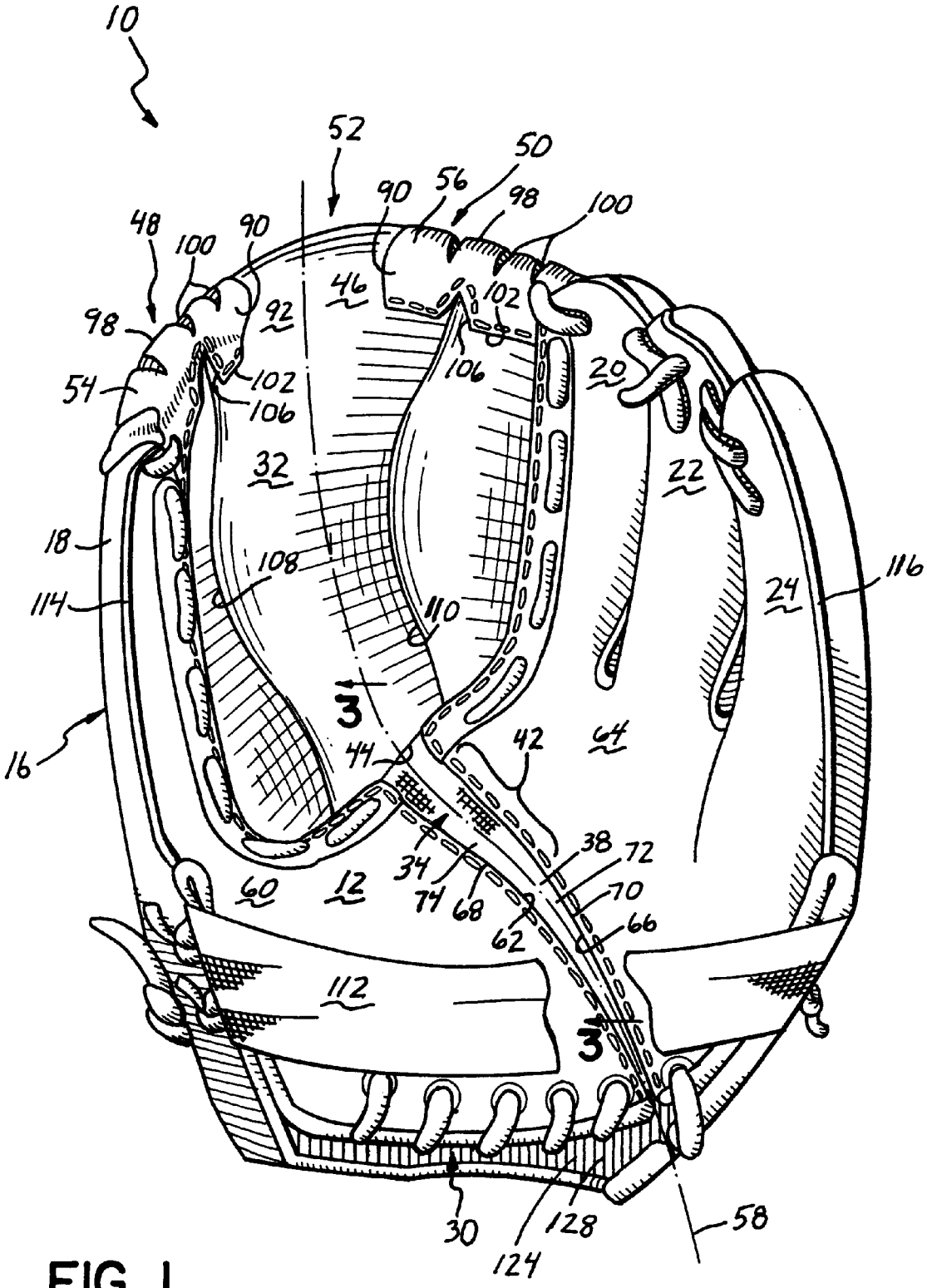
FIG. 1 is a schematic front perspective view of a baseball glove in accordance with the principles of the present invention.
Figure 2:
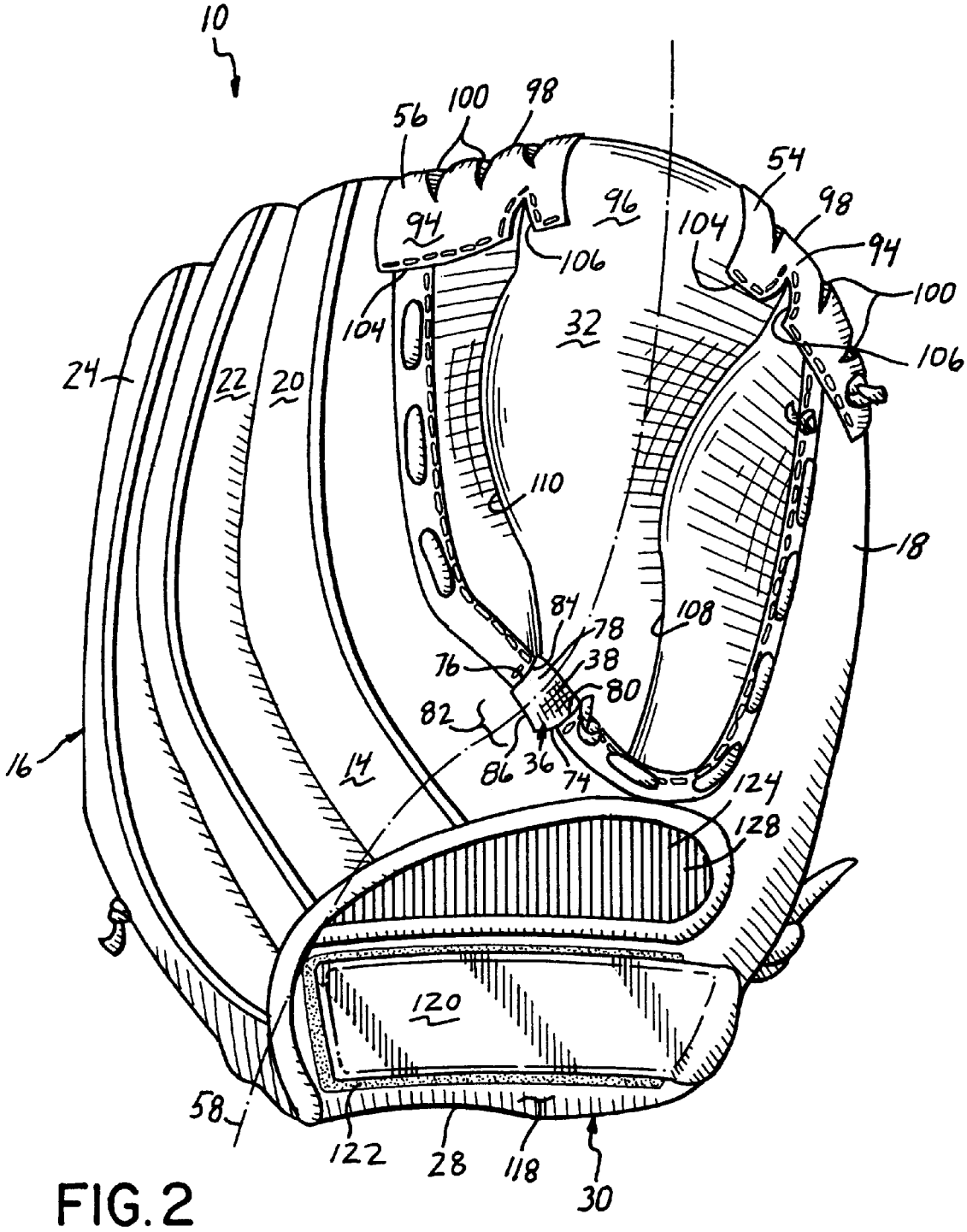
FIG. 2 is a schematic back perspective view of the glove shown in FIG. 1.

With reference to FIGS. 1 and 2, a baseball glove 10 according to the principles of the invention includes a front panel 12 and a back panel 14 which, together, define a glove shell 16. The glove shell 16 has a thumb stall 18, several finger stalls 20, 22, 24, a front panel bottom edge 26, also referred to as a heel, a back panel bottom edge 28, and a hand-receiving opening 30 positioned between the front and back panel bottom edges 26, 28. In addition, the baseball glove 10 has a web 32 positioned between the thumb stall 18 and a first finger stall 20, with the web 32 securably fastened to the glove shell 16. The baseball glove 10 further includes a front panel hinge 34 integrally connected to a back panel hinge 36, with the integrally connected front and back panel hinges collectively referred to herein as a "flexible hinge" 38.

Figure 3:
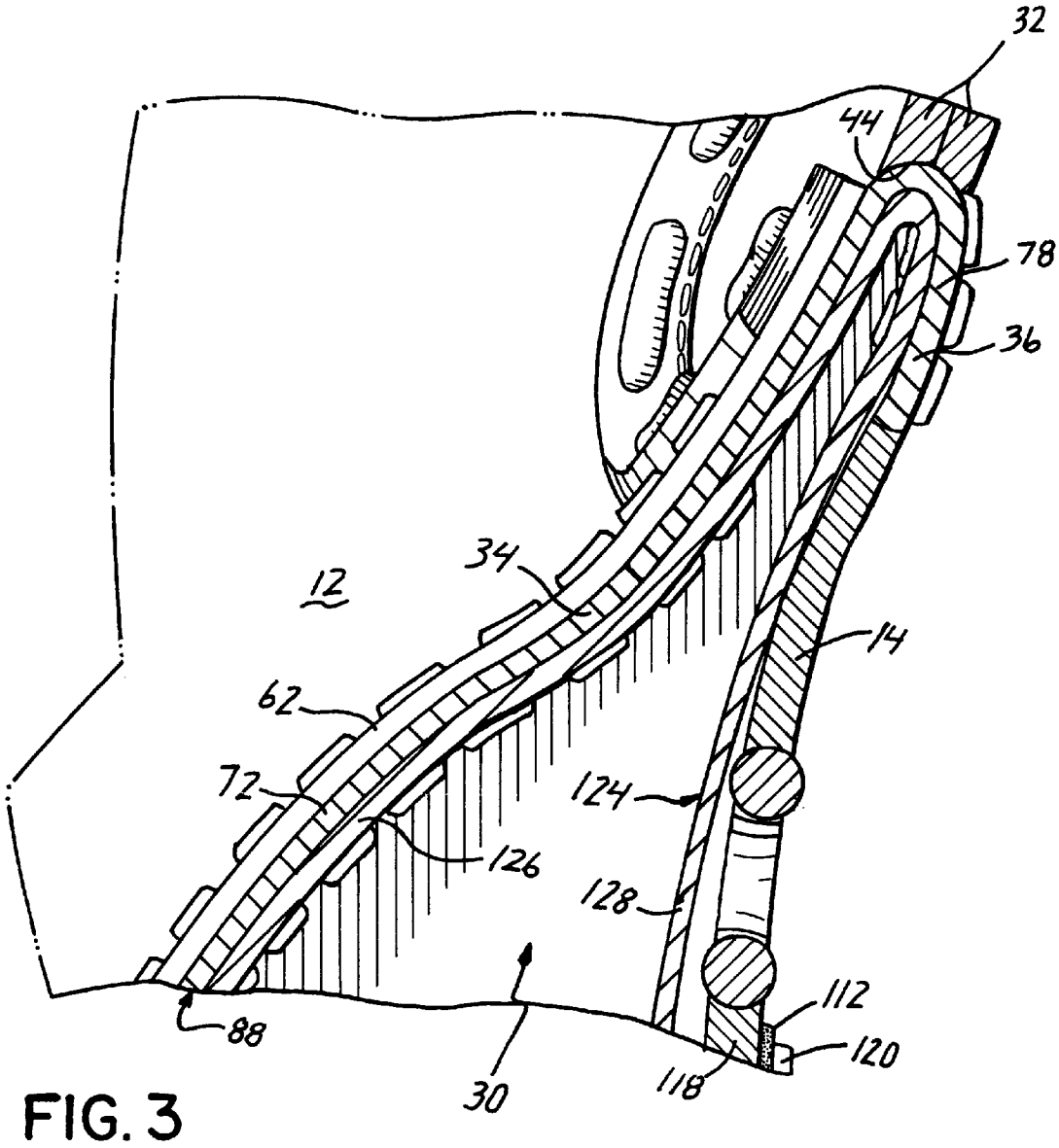
FIG. 3 is a schematic partial cross-sectional view of a portion of the glove of FIG. 1 taken along line 3—3.

The flexible hinge 38 extends from a portion of a front panel base region 40 adjacent the front panel bottom edge 26, across a palm region 42 of the front panel 12, and up to a bottom edge 44 of the web 32. At this point, and as best seen in FIG. 3, the flexible 38 hinge passes from the front panel 12 to the back panel 14, where the flexible hinge 38 extends from the bottom edge 44 of the web 32 toward the back panel bottom edge 28. This flexible hinge 38 offers a tremendous advantage to a ballplayer by greatly reducing the amount of force required by a hand to flex the glove into a closed, or ball-trapping, orientation.

The flexibility of the baseball glove 10 further enhanced by several features of the web 32. For example, and with reference to FIGS. 1 and 2, the web 32 includes an upper region 46 having a first section 48, a second section 50, and a third section 52. While the first and second sections 48, 50 have a first and second overwrap piece 54, 56 respectively, the third section 52, which is positioned between the first and second sections 48, 50, does not have an overwrap piece. Moreover, this third section 52 also does not include any lacing or additional material which might stiffen this centrally positioned section 52 of the web upper region 46. As shown in FIGS. 1 and 2, each of the first and second sections 48, 50 occupies approximately one-third of the length of the web upper region 46, with the third section 52 centrally positioned along the remaining one-third of the length. Because this third section 52 of the web upper region 46 is free of additional materials, the web 32, itself, provides enhanced flexibility while requiring significantly reduced force to close the web 32. Accordingly, a ball player has to spend little if any time breaking in the web 32 of the baseball glove. Furthermore, the centrally-positioned third section 52 of the web upper region 46 is aligned so as to cooperate with the flexible hinge 38 of the glove, thereby forming a uniform flex line 58, and further enhancing the "ready to play" benefit of the glove 10.

In further detail, and with regard to FIG. 1, the particular glove version 10 shown has a front panel 12 which includes a first panel section 60 having a first edge 62, and a second panel section 64 having a second edge 66. The front panel hinge 34 has a first hinge edge 68 comprising the first panel section first edge 62, and a second hinge edge 70 comprising the second panel section second edge 66. As shown, the first edge 62 is connected to the second edge 66 by a front flexible spanning member section 74, with the first and second edges 62, 66 being in substantially abutting relationship adjacent the front panel bottom edge 26, and gradually increasing in inter-edge distance as the edges 62, 66 extend across the palm region 42 to the web bottom edge 44.

As shown in FIG. 2, the glove shell back panel 14 has a back panel hinge 36 including a first hinge edge 74 connected to a second hinge edge 76 by a back flexible spanning member section 78. In this particular glove version 10, the first hinge edge 74 comprises a first edge 80 of a back panel cut-out 82, and the second hinge edge 76 comprises a second edge 84 of the back panel cut-out 82. The cut-out 82 further includes a base edge 86 positioned between, and at the base of, the first and second edges 80, 84.

As best seen in FIG. 3, a flexible spanning member 88, comprising the member sections 72, 78, is formed of a single piece of material which extends from the front panel 12 to the back panel 14, passing beneath the bottom edge 44 of the web 32.

As shown in FIGS. 1 and 2, each of the first and second overwrap pieces 54, 56 includes additional features which further enhance flexibility of the web 32, and therefore, of the glove 10 itself. In further detail, each overwrap piece 54, 56 has a front face 90 positioned on a front layer 92 of the web 32, a back face 94 positioned on a back layer 96 of the web 32 and an upper end portion 98 connecting the front face 90 with the back face 94. In order to further enhance flexibility, each overwrap piece 54, 56 includes a plurality of cut-outs 100 positioned along the upper end portion 98 and extending partially along the front and back faces 90, 94. In addition, each overwrap piece 54, 56 has a front face bottom edge 102 and a back face bottom edge 104, with each bottom edge 102, 104 having a notch 106.

The baseball glove 10 also includes several features which are not directed specifically at enhancing glove flexibility, but which are directed toward making it easier for a ball player to catch and retain a ball in the glove. For example, as may be seen in FIGS. 1 and 2, this particular glove includes three finger stalls 20, 22, 24, as opposed to the conventional four finger stalls. In this manner, the glove 10 may be provided with a web 32 which is significantly wider than webs found on traditional baseball gloves. The greater width of the web 32 greatly enhances the catching area of the glove 10, thereby making it easier for a ball player to both catch and trap a ball within the glove 10.

In order to further enhance the ball trapping ability of the glove 10, and as shown in FIGS. 1 and 2, each of the front and back layers 92, 96 of the web 32 has a first pleat 108 and a second pleat 110. In brief, each of the pleats 108, 110 is formed by providing a web template (not shown) which is wider than the distance between the thumb stall 18 and the first finger stall 20. This greater template width enables the formation of each of the pleats. Accordingly, when a ball hits the front layer 92 of the web 32, each of the pleats 108, 110 of both the front and back layers 92, 96 expands in width, thereby absorbing some of the energy from the ball, as well as causing the formation of an enlarged, deepened web pocket, thereby making it easier for a player to keep the ball in the web pocket.

With reference to FIG. 1, the baseball glove 10 also has a ball-retention member 112 which is positioned adjacent the bottom edge 26, or heel, of the front panel 12. As shown, the retention member 112 spans across the front panel 12 of the glove 10, extending from a first peripheral edge 114 on one side of the glove to a second peripheral edge 116 on the opposite side of the glove 10. The retention member 112 is yet another tool to make the baseball glove 10 more enjoyable to use. For example, if a ballplayer attempts to field a ground ball, the retention member 112 will reduce the likelihood that the ball will roll across and over the front panel 12 of the glove 10. Alternatively, if a player fields a fly ball, the retention member 112 will reduce the chances of the ball rolling off of the glove 10 if the ball is not caught securely within the pocket formed by the web 32. Advantageously, the ball-retention member 112 is removable, so that a player may continue to develop his or her skills without the extra assistance of the retention member 112.

As shown in FIG. 2, the back panel 14 of the glove 10 has a base region 118 including a Velcro® strap 120 and a corresponding Velcro® patch 122. In this fashion, a user may release the Velcro® strap 120 before placing a hand through the hand-receiving opening 30 and into the glove interior. Once the hand is positioned within the glove 10, the user may position the Velcro® strap 120 against the corresponding Velcro® 122 patch so as to provide a comfortable yet snug fit around the lower portion of the hand and wrist (not shown).

As seen in FIGS. 1–3, the glove shell 16 further includes a liner 124 which is connected to the interior of the glove shell 10. The liner 124 is a conventional liner, including a liner front panel 126 and a liner back panel 128, with the liner 124 providing a degree of additional padding and comfort for the user.

The baseball glove may be made by forming particular component parts and subsequently attaching the component parts together. For example, a front panel subassembly may be formed by positioning the front portion of the flexible spanning member on the liner front panel, and positioning the first panel section and second panel section on top of the spanning member-liner combination, with the longitudinal side edges of the spanning member front portion extending beneath and overlapping the spaced-apart first and second panel section edges, at which point the front panel may be formed by stitching the respective panel sections to the front portion of the flexible spanning member and to the liner front panel. A back panel subassembly may be formed by connecting a liner back panel to the back panel using any conventional technique. At this point, the glove shell may be partially formed using conventional methods. For example, the front panel sub-assembly and back panel sub-assembly may be stitched together about their peripheral edges.

At this point, the web assembly may be formed and subsequently connected to the glove shell. Depending upon the particular version of the baseball glove, including, for example, the number of finger stalls included in the glove shell, the particular web may be a web of substantially average width, or a web having a significantly wider width in comparison with other versions of the glove.

Accordingly, it is necessary to measure the width between the thumb stall and the first finger stall in forming a web template. With this width dimension, as well as the length dimension, in mind, a web template advantageously may be formed by providing a single piece of material which, when folded over upon itself, forms a web having a front layer, a back layer, and an upper edge along the upper region, which is a seamless upper edge.

At this point, the first and second pleats may be formed in each of the front and back layers of the web, and the first and second overwrap pieces may be installed, with these steps being performed in a temporally overlapping relationship. Each overwrap piece may be created by forming an overwrap template which is a substantially rectangular layer of material. One or more cut-outs are formed across the overwrap template, and a notch is formed in the bottom edge of both the front face and back face of the particular overwrap piece. Each pleat may be formed conveniently by forming a pinch or crease in the web front layer adjacent the upper edge, in the first section of the upper region, and tacking or stitching the pinched portion of fabric in order to maintain the pinch or crease, as will be understood by those of ordinary skill in the art. This procedure is repeated in similar fashion in the lower region of the web front layer, adjacent the web bottom edge, in a quadrant of the web front panel lower region which is in general alignment with the location of the pleat formed adjacent the upper edge of the first section of the web upper region. As will be appreciated by those of ordinary skill, this procedure is repeated in forming the second pleat of the web front layer, as well as the first and second pleats of the web back layer.

Once the respective pleats have been formed, the first and second overwrap pieces may be connected to the web material using conventional methods. If desired, stitching may be used. Advantageously, the upper pinch or crease of each pleat is positioned along the web such that the pinch or crease is positioned generally at or above the apex of the corresponding notch in the corresponding overwrap piece, thereby obtaining the maximum benefits of both the pleat and overwrap features of the invention.

At this point, the back portion of the flexible spanning member may be properly oriented between the baseball glove back panel and liner back panel, and these three layers may be stitched together.

In connecting the web assembly to the glove shell, it is beneficial to stitch connecting strips or members to the side and bottom edges of the web front layer and web back layer. So as not to interfere with the enhanced flexibility offered by the flexible-hinge aspect of the baseball glove, two separate, spaced-apart, connecting members are joined to the web front layer, and two separate, spaced-apart, connecting members are joined to the web back layer, with conventional stitching being one method of attachment. Each of these connecting members includes a series of openings along its length, thereby enabling the web assembly to be attached to the glove shell simply by orienting the web panel between the thumb stall and first finger stall of the glove shell, aligning the openings in the respective connecting members with the openings in the glove shell adjacent the web panel, and "threading" lacing through these aligned openings, thereby securely fastening the web to the glove shell.

The removable ball-retention member may be formed and positioned by providing a piece of material, sized to correspond with the width of the glove, adjacent the bottom edge of the front panel, and connecting the ball-retention member using a conventional connector, such as lacing or the like, which may easily be removed by the user, if desired. In addition, as will be understood by one of ordinary skill, the Velcro® strap assembly is formed along the base region of the back panel of the glove using conventional methods.

With regard to the materials used to form the glove, any suitable baseball glove material may be used, as will be readily appreciated by those of ordinary skill in the field. For example, if desired, the front panel first and second panel sections, the back panel, the glove shell liner, and the web may be made of one or more types or grades of leather. For example, the leather used to form the web, including the overwrap pieces, as well as the leather used to form the glove shell liner, may be a leather which is more soft and supple than the leather or leathers selected for other components of the glove. In addition, conventional lacing and stitching materials may be used. With regard to the flexible hinge, any material which promotes the enhanced flexibility of the baseball glove may be used. Non-limiting examples of such materials include leather, nylon, and fleece-backed poly-cotton. Additionally, the ball-retention member may be made of any suitable material, with non-limiting examples including leather and fleece-backed poly-cotton.

In use, the baseball glove provides a far more enjoyable ball playing experience for many different types of players, including, for example, those with undeveloped hand closure strength, as well as those who simply seek a glove which is ready to use "out of the box" and which does not require the typical investment of time, frustration, and/or additional money to make the glove playable. And because of the enhanced flexibility and enhanced ball-trapping features of the glove, a ball player is much more likely to catch and retain a ball in the glove, thereby making the game far more enjoyable for him or her.

While the present invention has been illustrated by description of a particular version, and while the illustrative version has been described in considerable detail, it is not the intention of the inventor to restrict, or in any way limit, the scope of the appended claims to such detail. Additional advantages and modifications readily will appear to those skilled in the art. The invention, in its broader aspects, is therefore not limited to the specific details, representative apparatus and methods, and illustrative example shown and described. Accordingly, departures may be made from such details without departing from the spirit and scope of the inventor's general inventive concept.

What is claimed is:

1. A baseball glove, comprising:

a glove shell having a front panel, a back panel, a thumb stall, a finger stall, and a hand-receiving opening, the front panel including a bottom edge;

a web positioned between the thumb stall and the finger stall; and a front panel hinge extending along the front panel between the web and the bottom edge;

the front panel hinge including a first hinge edge and a second hinge edge distinct from the first hinge edge, the first hinge edge being connected to the second hinge edge.

2. The glove of claim 1 wherein the first hinge edge is connected to the second hinge edge by a front flexible spanning member.

3. The glove of claim 2 wherein the flexible first and second hinge edges taper toward the bottom edge.

4. The glove of claim 1 wherein the front panel has a base region positioned between the finger stall and the bottom edge, the front panel hinge extending between the web and the base region.

5. The glove of claim 1 wherein the front panel hinge extends from the web to the bottom edge.

6. The glove of claim 1 wherein the web has an upper region including a first section having a first overwrap piece.

7. The glove of claim 6 wherein the upper region includes a second section having a second overwrap piece.

8. The glove of claim 7 wherein the upper region includes a third section positioned between the first and second sections, the third section being free of an overwrap piece.

9. The glove of claim 1 wherein the web has a front layer including an upper region and a lower region, the front layer including a first pleat extending between the upper region and the lower region.

10. The glove of claim 1 wherein the web has a back layer including an upper region and a lower region, the back layer including a first pleat extending between the back layer upper region and the back layer lower region.

11. The glove of claim 1 further including a ball-retention member adjacent the bottom edge of the front panel.

12. The glove of claim 1 wherein the front panel further includes a first panel section having a first edge, and a second panel section having a second edge, the first panel section first edge and the second panel section second edge being substantially similar in flexibility.

13. The glove of claim 1 wherein the front panel further includes a first panel section having a first edge, and a second panel section having a second edge, the first panel section first edge and the second panel section second edge being substantially similar in thickness.

14. The glove of claim 1 wherein the front panel further includes a first panel section and a second panel section, the first panel section and the second panel section being substantially similar in flexibility.

15. The glove of claim 1 wherein the front panel further includes a first panel section and a second panel section, the first panel section and the second panel section being substantially similar in thickness.

16. The glove of claim 1 wherein the front panel further includes a first panel section and a second panel section, the first panel section and the second panel section including a single piece of material.

17. The glove of claim 1 wherein the front panel further includes a first panel section and a second panel section, the first panel section being formed of a first piece of material, and the second panel section being formed of a second piece of material.

18. A baseball glove, comprising;

a glove shell having a front panel, a back panel, a thumb stall, a finger stall, and a hand-receiving opening, the back panel including a bottom edge;

a web positioned between the thumb stall and the finger stall; and a back panel hinge extending along the back panel between the web and the bottom edge;

the back panel hinge including a first hinge edge and a second hinge edge, the first hinge edge being connected to the second hinge edge.

19. The glove of claim 18 wherein the first hinge edge is connected to the second hinge edge by a back flexible spanning member.

20. The glove of claim 18 wherein the web has an upper region including a first section having a first overwrap piece, and a second section having a second overwrap piece.

21. The glove of claim 20 wherein the upper region includes a third section positioned between the first and second sections, the third section being free of an overwrap piece.

22. The glove of claim 18 wherein the web has a front layer including an upper region and a lower region, the front layer including a first pleat extending between the upper region and the lower region.

23. A baseball glove, comprising:

a glove shell having a front panel, a back panel, a thumb stall, a finger stall, and a hand-receiving opening, the front panel including a bottom edge, and the back panel including a bottom edge;

a web positioned between the thumb stall and the finger stall;

a front panel hinge extending along the front panel between the web and the bottom edge;

the front panel hinge including a first hinge edge and a second hinge edge, the first hinge edge being connected to the second hinge edge; and a back panel hinge extending along the back panel between the web and the bottom edge;

the back panel hinge including a first hinge edge and a second hinge edge, the first hinge edge being connected to the second hinge edge.

24. The glove of claim 23 wherein the front panel first hinge edge is connected to the front panel second hinge edge by a front flexible spanning member, and the back panel first hinge edge is connected to the back panel second hinge edge by a back flexible spanning member.

25. The glove of claim 24 wherein the front and back flexible spanning members are directly connected together.

26. The glove of claim 25 wherein a single piece of flexible spanning member material forms the front and back spanning members, the material extending from the front panel to the back panel.

* * * * *